United States Patent [19]

Seffens

[11] 4,298,043

[45] Nov. 3, 1981

[54] LOG TRANSPORT SYSTEM

[75] Inventor: David E. Seffens, Monroe, La.

[73] Assignee: H. Jack Flanders Co., Little Rock, Ark.

[21] Appl. No.: 144,233

[22] Filed: Apr. 28, 1980

[51] Int. Cl.[3] ..... B27B 31/00

[52] U.S. Cl. ..... 144/136 R; 144/245 A

[58] Field of Search ..... 144/1 R, 3 R, 242 R, 144/242 A, 242 C, 245 R, 245 A, 246 R, 246 C, 246 F, 253 R, 312, 136 R, 114 R, 117 R, 128, 2 R; 198/575, 576, 698, 785

[56] References Cited

U.S. PATENT DOCUMENTS

| | | | |
|---|---|---|---|
| 3,313,329 | 4/1967 | Mitten | 144/3 R |
| 3,811,487 | 5/1974 | Warren et al. | 144/312 |
| 3,870,169 | 3/1975 | Kojima | 198/575 |
| 3,971,423 | 7/1976 | Miller | 144/242 R |
| 4,152,960 | 5/1979 | Detjen | 144/312 |

*Primary Examiner*—W. D. Bray

*Attorney, Agent, or Firm*—Walker & McKenzie

[57] ABSTRACT

A system for transporting a log through one or more work stations. The system includes a first conveyor having a pair of endless conveyor chains arranged side-by-side a spaced apart distance. The system also includes a second conveyor having a single endless conveyor chain. At least a portion of the conveyor chain of the second conveyor extends between the conveyor chains of the first conveyor whereby a log can be transferred between the first and second conveyor without any loss of positive support and the like.

7 Claims, 6 Drawing Figures

LOG TRANSPORT SYSTEM

BACKGROUND OF THE INVENTION

1. Field of the Invention

The present invention relates in general to conveyor systems for transporting logs and the like through one or more work stations.

2. Description of the Prior Art

Various conveyor systems for conveying logs through various work stations have heretofore been developed. Detjen, U.S. Pat. No. 4,146,072 discloses a conveyor system in which a log is held between a drive dog positioned on an endless conveyor chain above the log and a hold-back dog positioned on an endless chain located beneath the log. The log is initially supported on top of a pair of longitudinal rolls. After passing through a work station (e.g., a pair of bandsaw units) the log is supported and stabilized by way of a center beam and a plurality of transverse support rolls. Mitten, U.S. Pat. No. 3,487,886 discloses a conveyor system in which a log passes from an initial support member through a cutter head for cutting longitudinal grooves in the log and then onto a guide shoe for entering the grooves. The log is then conveyed past a number of work stations. None of the above patents disclose or suggest the present invention.

SUMMARY OF THE INVENTION

The present invention is directed towards improving upon prior transport systems. The concept of the present invention is to overlap the end of sequential support conveyors to positively support a log or the like as it is transferred from one support conveyor to another.

The transport system of the present invention includes, in general, a first conveyor means for transporting a log or the like, the first conveyor means having first and second conveyor members arranged side-by-side a spaced apart distance and having a drive means for driving the first and second conveyor members; and a second conveyor means for transporting the log or the like, the second conveyor means including a conveyor member and a drive means for driving the conveyor member, at least a portion of one end of the conveyor member of the second conveyor means extending between at least a portion of one end of the first and second conveyor members of the first conveyor means so that the log or the like will remain positively supported as it is transferred from one of the conveyor means to the other.

DESCRIPTION OF THE PREFERRED EMBODIMENT

Figure 1:
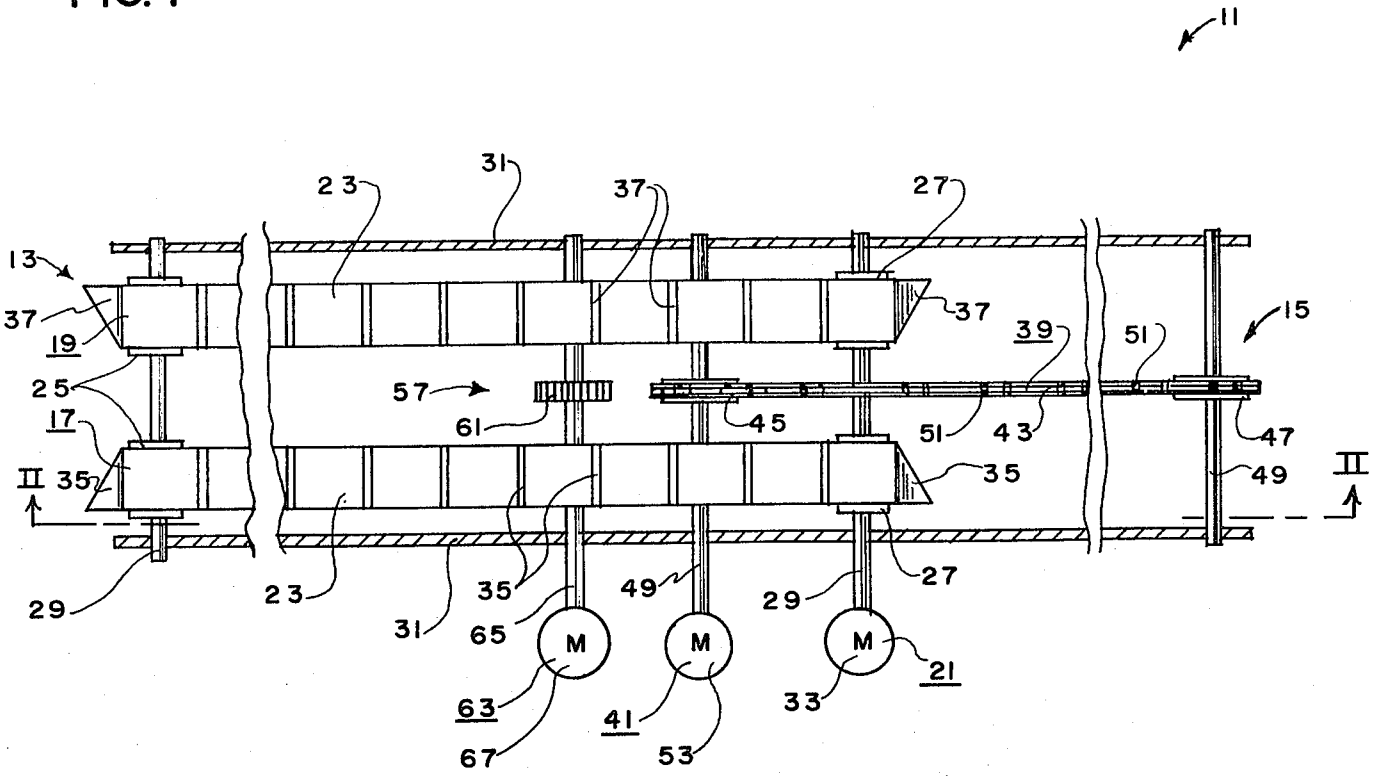
FIG. 1 is a partially sectional top plan view of the log transport system of the present invention.
Figure 2:
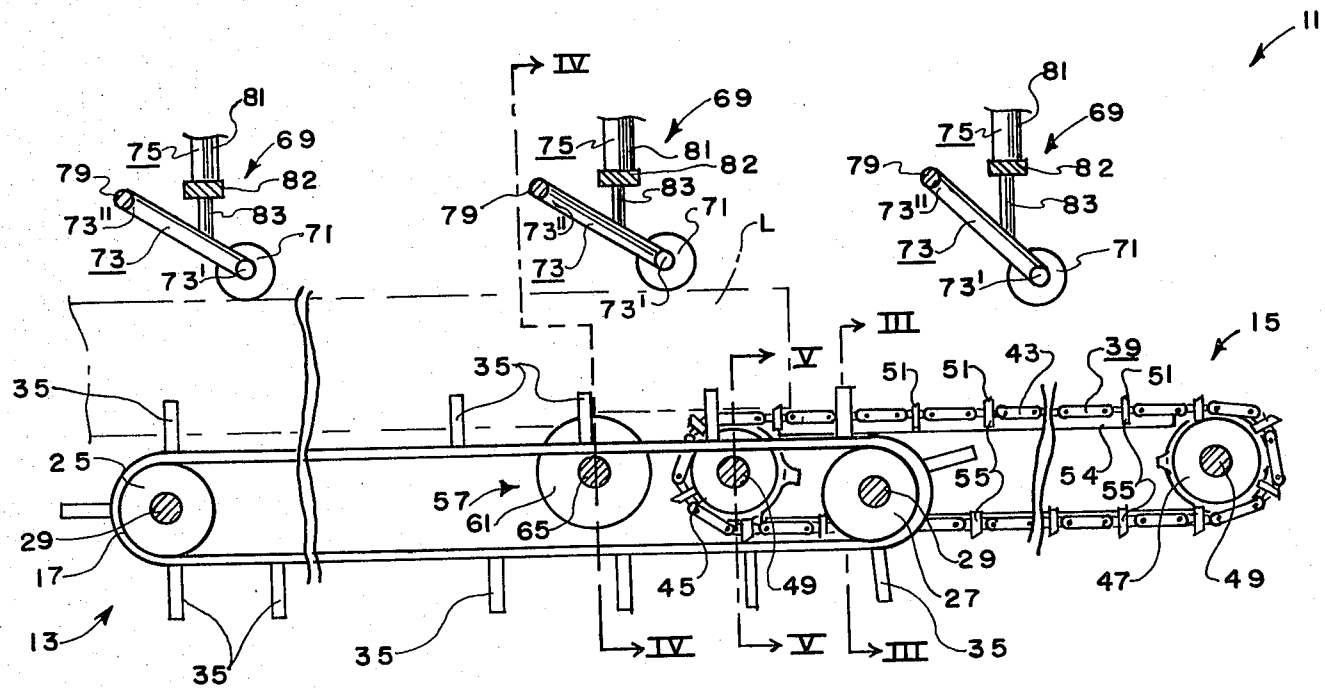
FIG. 2 is a sectional view substantially as taken on line II—II of FIG. 1 with a log shown in broken lines.

The log transport system 11 of the present invention is for use in transporting a log L or the like through one or more work stations or the like (see, in general, FIGS. 1 and 2). The log transport system 11 comprises, in general, a first conveyor means 13 and a second conveyor means 15 associated with one another in such a manner to allow the log L to be transferred between the first and second conveyor means 13, 15 while being positively supported.

Figure 3:
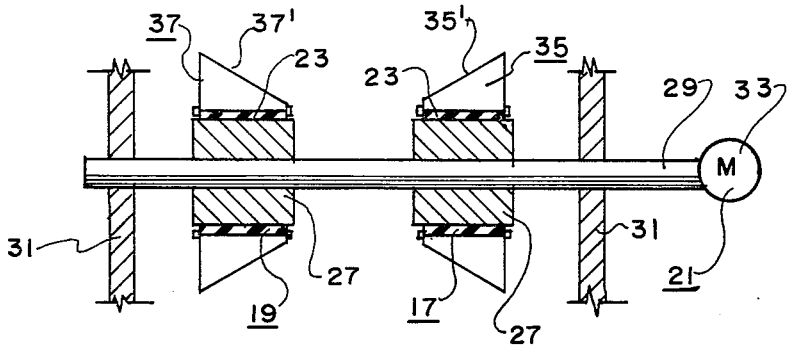
FIG. 3 is a sectional view substantially as taken on line III—III of FIG. 2.
Figure 4:
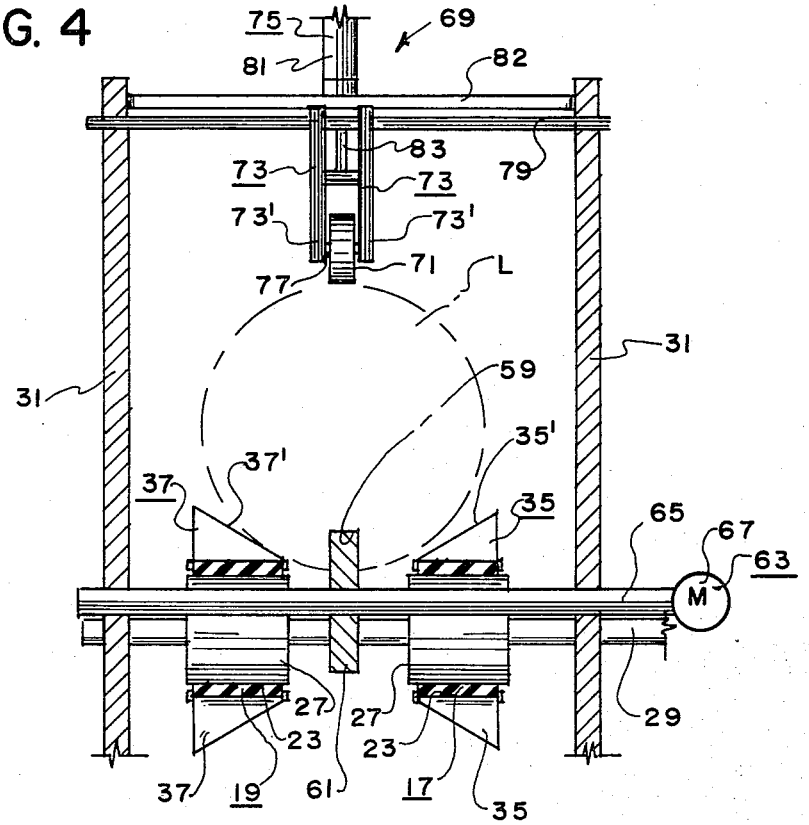
FIG. 4 is a sectional view substantially as taken on line IV—IV of FIG. 2.
Figure 5:
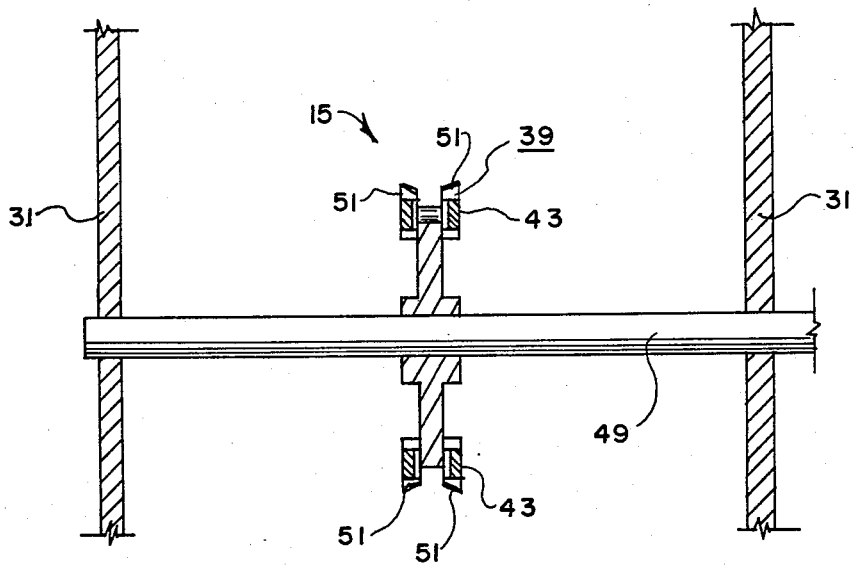
FIG. 5 is a sectional view substantially as taken on line V—V of FIG. 2.

The first conveyor means 13 includes a first conveyor member 17 and a second conveyor member 19. The first and second conveyor members 17, 19 are arranged side-by-side a spaced apart distance. The first conveyor means 13 also includes a drive means 21 for driving the first and second conveyor members 17, 19 in a synchronous manner. Each conveyor member 17, 19 preferably consists of an endless chain member 23. Each chain member 23 may be positioned about a first sprocket 25 and a second sprocket 27. The first sprocket 25 defines the infeed ends of the first and second conveyor members 17, 19 while the second sprocket 27 defines the outfeed ends of the first and second conveyor members 17, 19. The sprockets 25, 27 are rotatably supported in any manner apparent to those skilled in the art to locate the first conveyor means 13 in relationship to the log transport system 11. More specifically, axles 29 may pass through the sprockets 25, 27 and be rotatably attached to a frame means 31 in any manner apparent to those skilled in the art such as by way of bushings (not shown) whereby the first and second conveyor members 17, 19 are located relative to the frame means 31. The drive means 21 may be coupled to the conveyor members 17, 19 in any manner apparent to those skilled in the art so as to cause rotation thereof. For example, the drive means 21 may consist simply of an electric motor 33 or the like operatively coupled to one of the axles 29 in such a manner so as to cause rotation of the axles 29 and, thereby, cause rotation of the first sprockets 25 whereby the first and second conveyor members 17, 19 will be caused to rotate about the first and second sprockets 25, 27 in a manner which should now be apparent to those skilled in the art. The first conveyor means 13 also preferably includes a plurality of first teeth members 35 for being attached to the first conveyor member 17 along the length thereof and preferably includes a plurality of second teeth members 37 for being attached to the second conveyor member 19 along the length thereof. Each of the first teeth members 35 has an upper edge 35' that slopes toward the second conveyor member 19 (see, in general, FIGS. 3 and 4). Likewise, each of the second teeth members 37 has an upper edge 37' that slopes toward the first conveyor member 17 (see, in general, FIGS. 3 and 4). The teeth members 35, 37 will grippingly engage the log L in a manner which should now be apparent to those skilled in the art and cause the log L to be conveyed along the first and second conveyor members 17, 19 when the electric motor 33 is activated. The sloping upper edges 35', 37' of the teeth members 35, 37 will also cause the log L to be substantially centered between the first and second conveyor members 17, 19 in a manner which should now be apparent to those skilled in the art.

Figure 6:
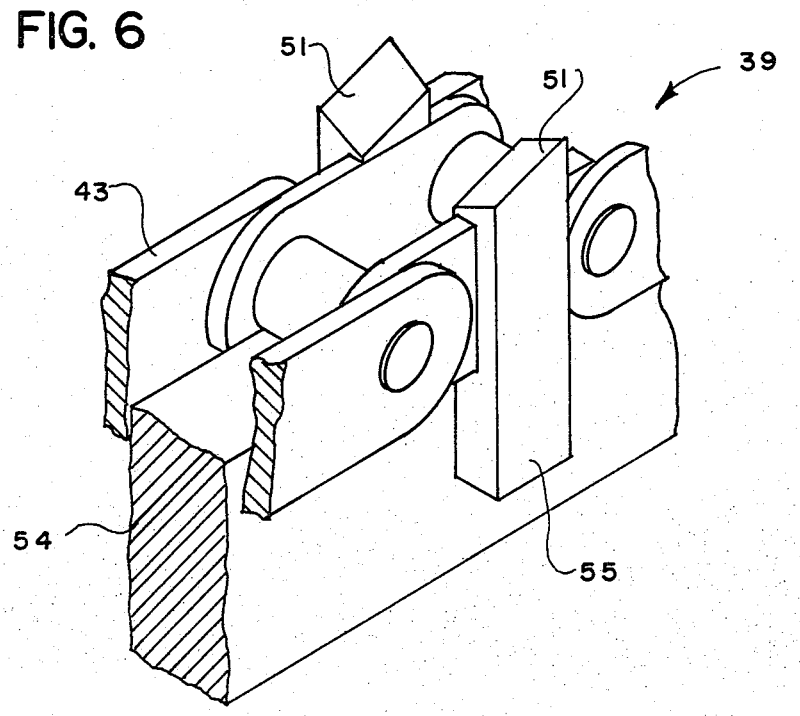
FIG. 6 is a pictorial sectional view of a portion of the log transport system of the present invention.

The second conveyor means 15 includes a conveyor member 39 and a drive means 41 for driving the conveyor member 39. The conveyor member 39 preferably consists of an endless chain member 43. The endless chain member 43 may extend about a first sprocket member 45 and a second sprocket member 47. The infeed end of the conveyor member 39 is defined by the first sprocket member 45 and the outfeed end of the conveyor member 39 is defined by the second sprocket member 47. The first and second sprocket members 45, 47 are located in a fixed position relative to the first and second conveyor members 17, 19 of the first conveyor means 13 in any manner apparent to those skilled in the art. For example, axles 49 may extend through each sprocket member 45, 47 and may be rotatably secured to the frame means 31 in any manner apparent to those skilled in the art such as by way of bushings (not shown). The second conveyor means 15 preferably includes a plurality of teeth members 51 fixedly attached to the chain 43 for movement therewith to grippingly engage the log L in a manner hereinafter to become apparent. The drive means 41 may be adapted to cause the endless chain member 43 to rotate in any manner apparent to those skilled in the art. For example, the drive means 41 may consist simply of an electric motor 53, operatively coupled to one of the axles 49 for causing the first sprocket member 45 to rotate thereby causing the endless chain member 45 to rotate. The second conveyor means 15 may include a guide means 54 for guiding the chain 43 between the first and second sprocket members 45, 47 in a manner which should now be apparent to those skilled in the art. The chain 43 may include a plurality of leg portions 55 for straddling the guide means 54 as clearly shown in FIG. 6 to coact with the guide means 54 in guiding the chain 43 between the first and second sprocket members 45, 47. The second conveyor means 15 may also include a plurality of roller members (not shown) attached to the frame means 31 substantially transverse to and located on either side of the chain 43 for preventing any substantial sidewards wobbling-type movement of the log L as it is transported by the second conveyor means 15 as will now be apparent to those skilled in the art.

The first end of the conveyor member 39 of the second conveyor means 15 overlaps a portion of the second end of the first and second conveyor members 17, 19 of the first conveyor means 13. More specifically, the first end of the conveyor member 39 of the second conveyor means 13 is positioned between the first and second conveyor member 17, 19 of the first conveyor means 13 adjacent the second end thereof. Thus, when the first and second conveyor means 13, 15 are activated to transfer the log L from the first ends thereof to the second ends thereof, the log L will be transferred from the first conveyor means 13 to the second conveyor means 15 while being positively supported by the first and second conveyor members 17, 19 of the first conveyor means 13.

The log transport system 11 preferably includes a cutter head means 57 for cutting a longitudinal flat transport surface 59 in the log L as the log L is transported by the first conveyor means 13. The cutter head means 57 includes a cutter head member 61 positioned between the first and second conveyor members 17, 19 of the first conveyor means 13 and includes a drive means 63 for driving the cutter head member 61. The cutter head member 61 may be of any construction apparent to those skilled in the art for cutting a longitudinal flat transport surface by removing irregular bottom surface in the log L. The cutter head member 61 may be supported by an axle 65 that is in turn rotatably supported by the frame means 31 in any manner apparent to those skilled in the art such as by way of bushings (not shown). The drive means 63 may consist simply of an electric motor 67 operatively coupled to one end of the axle 65 for causing the axle 65 and, therefore, the cutter head member 61 to rotate.

The log transport system 11 also preferably includes a plurality of hold-down means 69 spaced along the length of the first and second conveyor means 13, 15 to hold the log L down on the first and second conveyor means 13, 15 as the log L is transferred therealong. Each hold-down means 69 includes a roller 79 for contacting an upper portion of the log L, an arm member 73 for pivotally attaching the roller 71 to frame means 31, and means 75 for forcing the roller 71 against the log L. The rollers 71 may be spiked (not shown). The arm member 73 preferably has a first end 73' pivotally attached to the roller 71 in any manner apparent to those skilled in the art such as by way of an axle 77 passing through the first end 73' of the arm members 73 and through the roller 71, and includes a second end 73'' pivotally attached to the frame means 31 in any manner apparent to those skilled in the art such as by way of an axle 79 passing through the second end 73'' of the arm member 73 and through the frame means 31. The means 75 for forcing the roller 71 against the log L may consist simply of a nonpowered hydraulic piston means having the cylinder portion 81 thereof fixedly attached to the frame means 31 in any manner apparent to those skilled in the art such as by way of a cross-member 82 extending between the frame means 31 and the cylinder portion 81 and having the outer end of the rod portion 83 thereof attached adjacent the first end 73' of the arm member 73 in any manner apparent to those skilled in the art. The piston means will then act in substantially the same way as a shock absorber of a typical automobile and will force the roller 71 against the log L in a manner as will now be apparent to those skilled in the art.

The operation of the log transport system 11 is quite simple. The log L is first positioned on the first or infeed end of the first and second conveyor member 17, 19 of the first conveyor means 13 in any manner apparent to those skilled in the art. The teeth members 35, 37 of the first conveyor means 13 will form a cradle-like means to minimize the malpositioning of the log L due to knots, etc. With the drive means 21 activated, the first and second conveyor members 17, 19 will rotate cuasing the teeth members 35, 37 to grip the log L and transfer it towards the second or outfeed end of the first conveyor means 13. The hold-down means 69 will force the log L against the teeth members 35, 37. While the log L is positively supported on the first conveyor means 13 and as it is being conveyed down the first and second conveyor members 17, 19, the cutter head means 57 will cut the longitudinal flat surface 59 in the bottom of the log L. As the log L is further conveyed down the first conveyor means 13 and while it remains positively supported by the first and second conveyor members 17, 19, the conveyor member 39 of the second conveyor means 15 will engage the longitudinal flat transport surface 59. Thus, when the first end of the log L is conveyed off the second or outfeed end of the first and second conveyor members 17, 19 of the first conveyor means 13 it will be positively supported by the conveyor member 39 of the second conveyor means 15 to prevent any up and/or down movement of the log L as it is so conveyed. The teeth members 51 of the conveyor member 39 will grip the log L within the longitudinal flat transport surface 59 and convey the log L along the second conveyor means 15. Various work stations (not shown) such as chippers, etc., may be provided along the second conveyor means 15 to perform certain operations on the log L as it is conveyed along the second conveyor means 15 as will be apparent to those skilled in the art.

Although the invention has been described and illustrated with respect to a preferred embodiment thereof and a preferred use thereof, it is not to be so limited since changes and modifications may be made therein which are within the full intended scope of the invention.

I claim:

1. A transport system for transporting an object, said system comprising:

(a) first conveyor means for transporting the object, said first conveyor means including first and second conveyor members, said first and second conveyor members being arranged side-by-side a spaced apart distance, said first conveyor means including drive means for synchronously driving said first and second conveyor members;

(b) means for forming a transport surface in the object as the object is transported by said first conveyor means; and (c) second conveyor means for transporting the object, said second conveyor means including a conveyor member for engaging the transport surface in said object and including drive means for driving said conveyor member, a portion of said conveyor member of said second conveyor means extending between said first and second conveyor members of said first conveyor means for positively supporting the object as it is transported between said first and second conveyor means.

2. A log transport system for transporting a log through one or more work stations, said system comprising:

(a) first conveyor means for transporting the log, said first conveyor means including first and second conveyor members, said first and second conveyor members being arranged side-by-side a spaced apart distance, said first conveyor means including drive means for synchronously driving said first and second conveyor members;

(b) means for forming a transport surface in the log as it is transported by said first conveyor means; and (c) second conveyor means for transporting the log, said second conveyor means including a conveyor member for engaging the transport surface in the log and including drive means for driving said conveyor member, said conveyor member of said second conveyor means extending between said first and second conveyor members of said first conveyor means.

3. A log transport system for transporting a log through one or more work stations, said system comprising:

(a) first conveyor means for transporting the log, said first conveyor means including first and second conveyor members, said first and second conveyor members being arranged side-by-side a spaced apart distance, said first conveyor means including drive means for synchronously driving said first and second conveyor members;

(b) second conveyor means for transporting the log, said second conveyor means including a conveyor member and including drive means for driving said conveyor member, said conveyor member of said second conveyor means extending between said first and second conveyor members of said first conveyor means; and (c) a cutter head means for cutting a longitudinal flat transport surface in the underneath side of the log as the log is transported by said first conveyor means, said cutter head means including a cutter head member positioned between said first and second conveyor members of said first conveyor means and including drive means for driving said cutter head member.

4. The log transport system of claim 3 in which said second conveyor means includes a plurality of teeth members for being attached to said conveyor member thereof and for supporting said log through work stations and for engaging said flat transport surface cut into said log by said cutter head means.

5. The log transport system of claim 4 in which is included hold-down means for holding the log down on said first and second conveyor means.

6. The log transport system of claim 5 in which said first conveyor means includes a plurality of first teeth members for being attached to said first conveyor member thereof and includes a plurality of second teeth members for being attached to said second conveyor member thereof, each of said first teeth members having an upper edge that slopes toward said second conveyor member, each of said second teeth members having an upper edge that slopes toward first conveyor member.

7. A transport system for transporting an object, said system comprising:

(a) first conveyor means for transporting the object, said first conveyor means including first and second conveyor members, said first and second conveyor members being arranged side-by-side a spaced apart distance;

(b) a cutter head means for cutting a longitudinal flat transport surface in the underneath side of the object as the object is transported by said first conveyor means, said cutter head means including a cutter head member positioned between said first and second conveyor members of said first conveyor means; and (c) second conveyor means for transporting the object from said first conveyor means, said second conveyor means including a conveyor member for engaging the flat transport surface cut into the object by said cutter head means.

* * * * *